US011358035B2

(12) United States Patent
Barber

(10) Patent No.: US 11,358,035 B2
(45) Date of Patent: Jun. 14, 2022

(54) BALANCE POINT ALIGNMENT FOR GOLF SHAFTS AND GOLF CLUBS

(71) Applicant: Andrew T. Barber, Milton, GA (US)

(72) Inventor: Andrew T. Barber, Milton, GA (US)

( * ) Notice: Subject to any disclaimer, the term of this patent is extended or adjusted under 35 U.S.C. 154(b) by 0 days.

(21) Appl. No.: 17/144,653

(22) Filed: Jan. 8, 2021

(65) Prior Publication Data

US 2021/0275878 A1 Sep. 9, 2021

Related U.S. Application Data

(60) Provisional application No. 63/101,513, filed on Mar. 4, 2020, provisional application No. 63/101,514, filed on Mar. 4, 2020.

(51) Int. Cl.

| | |
|---|---|
| ***A63B 53/10*** | (2015.01) |
| ***A63B 53/12*** | (2015.01) |
| ***A63B 53/00*** | (2015.01) |
| ***A63B 53/02*** | (2015.01) |
| *A63B 102/32* | (2015.01) |

(52) U.S. Cl.

CPC ..... *A63B 53/007* (2013.01); *A63B 53/02* (2013.01); *A63B 2102/32* (2015.10)

(58) Field of Classification Search

CPC ..... A63B 53/10; A63B 53/12
USPC ..... 473/291, 292
See application file for complete search history.

(56) References Cited

U.S. PATENT DOCUMENTS 1,516,786 A * 11/1924 Prentiss ..... A63B 53/00 473/287
1,594,801 A * 8/1926 Stackpole ..... A63B 60/00 473/409
3,740,053 A 6/1973 Eiger
3,834,700 A * 9/1974 Averbach ..... A63B 53/00 473/409
4,128,242 A * 12/1978 Elkins, Jr. ..... A63B 60/46 473/409
4,203,598 A * 5/1980 Stuff ..... A63B 60/24 473/409
4,415,156 A * 11/1983 Jorgensen ..... A63B 60/46 473/409
4,461,479 A * 7/1984 Mitchell ..... A63B 60/24 473/297
5,094,101 A 3/1992 Chastonay
(Continued)

FOREIGN PATENT DOCUMENTS

JP 10066744 A * 3/1998 ..... A63B 53/10
JP 10099476 A * 4/1998
(Continued)

OTHER PUBLICATIONS

International Search Report; ISA/US; International Application No. PCT/US2021/020849; dated May 25, 2021; 2 pages.
(Continued)

*Primary Examiner* — Alvin A Hunter

(74) *Attorney, Agent, or Firm* — Taft Stettinius & Hollister LLP

(57) ABSTRACT

A shaft for a golf club includes a first end, a second end, and a demarcation. The first end is adapted to attach to a club head. The second end is adapted to receive a grip distal to the first end. The demarcation is positioned at or adjacent to the balance point of the golf club between the first end and the second end.

41 Claims, 11 Drawing Sheets

(56) References Cited

U.S. PATENT DOCUMENTS 5,265,872 A * 11/1993 Tennent ..... A63B 60/00 273/DIG. 7
5,277,059 A * 1/1994 Chastonay ..... A63B 60/42 473/297
5,417,108 A * 5/1995 Chastonay ..... A63B 60/42 473/289
5,467,984 A * 11/1995 Veux ..... A63B 53/00 473/287
5,599,242 A * 2/1997 Solviche ..... A63B 53/10 473/319
5,608,160 A * 3/1997 Chastonay ..... A63B 53/0466 73/65.03
5,755,826 A * 5/1998 Beach ..... A63B 53/10 473/316
5,792,946 A * 8/1998 Chastonay ..... A63B 60/42 73/65.03
5,813,922 A * 9/1998 Beach ..... A63B 60/00 273/DIG. 7
5,879,241 A * 3/1999 Cook ..... A63B 53/00 473/297
5,882,268 A * 3/1999 McIntosh ..... A63B 60/00 473/319
5,943,758 A * 8/1999 Haas ..... A63B 53/10 29/516
6,106,411 A * 8/2000 Edwards ..... A63B 53/00 473/409
6,135,896 A * 10/2000 Miao ..... A63B 53/007 473/340
6,139,444 A * 10/2000 Renard ..... A63B 53/12 273/DIG. 7
6,478,689 B1 * 11/2002 Hisamatsu ..... A63B 24/0021 473/319
6,506,128 B1 * 1/2003 Bloom, Jr. ..... A63B 60/00 473/297
7,507,165 B2 * 3/2009 Ban ..... A63B 53/00 473/316
8,066,583 B2 * 11/2011 Rice ..... A63B 53/12 473/282
8,608,586 B2 12/2013 Parente et al.
8,998,743 B2 * 4/2015 Nakamura ..... A63B 53/04 473/319
9,387,383 B2 * 7/2016 Hou ..... A63B 15/00
2003/0157990 A1 * 8/2003 Bloom, Jr. ..... A63B 60/00 473/297
2006/0142093 A1 * 6/2006 Moriyama ..... A63B 53/0466 473/297
2007/0105640 A1 * 5/2007 Ban ..... A63B 60/00 473/292
2007/0105641 A1 * 5/2007 Ban ..... A63B 60/00 473/292
2008/0146384 A1 6/2008 Hansen et al.
2010/0248856 A1 * 9/2010 Hunter ..... A63B 60/24 473/297
2012/0174419 A1 7/2012 Kuta
2012/0295730 A1 * 11/2012 Hasegawa ..... A63B 60/42 473/292
2013/0095943 A1 * 4/2013 Nakamura ..... A63B 60/00 473/292
2013/0095944 A1 * 4/2013 Nakamura ..... A63B 53/14 473/292
2014/0155190 A1 * 6/2014 Nakamura ..... A63B 53/00 473/292
2015/0024865 A1 * 1/2015 Nakamura ..... A63B 53/00 473/292
2015/0031467 A1 * 1/2015 Nakamura ..... A63B 60/42 473/292
2015/0087435 A1 * 3/2015 Nakamura ..... A63B 53/00 473/292
2015/0087436 A1 * 3/2015 Nakamura ..... A63B 60/42 473/292
2015/0360092 A1 * 12/2015 Nakamura ..... A63B 53/0466 473/292
2016/0067564 A1 * 3/2016 Ueda ..... A63B 53/14 473/292
2016/0067565 A1 * 3/2016 Ueda ..... A63B 60/42 473/292
2016/0067566 A1 * 3/2016 Ueda ..... A63B 53/14 473/292
2016/0250532 A1 * 9/2016 Griffin ..... A63B 53/00 473/292

FOREIGN PATENT DOCUMENTS

JP 10309334 A * 11/1998
KR 101569671 B1 11/2015

OTHER PUBLICATIONS

Written Opinion of the International Searching Authority; ISA/US; International Application No. PCT/US2021/020849; dated May 25, 2021; 8 pages.

* cited by examiner

BALANCE POINT ALIGNMENT FOR GOLF SHAFTS AND GOLF CLUBS

CROSS-REFERENCE TO RELATED APPLICATIONS

This application claims the benefit of U.S. Provisional Patent Application No. 63/101,513, filed on Mar. 4, 2020, and of U.S. Provisional Patent Application No. 63/101,514, filed on Mar. 4, 2020, the contents of each of which are hereby incorporated by reference in their entirety.

FIELD OF THE DISCLOSURE

The present disclosure generally relates to shafts for golf clubs. More particularly, the present disclosure relates to products, systems, and methods for identifying and utilizing the balance point of the golf club on the shaft thereof to assist golfers with their alignment before making a stroke.

BACKGROUND OF THE DISCLOSURE

Golf is a popular global game that has existed for hundreds of years. Golf clubs remain quite similar in shape and general construction (head, shaft, grip), while technology and composite material advances have been significant. Golf has many challenges in the game, and there is a large market for golf equipment and training aides that seek to assist with overcoming those challenges. A large challenge in golf is being able to adequately align oneself and identify the various contours of the putting surfaces (e.g., read the putting greens).

While devices exist that are designed to digitally read contour changes on the putting green, these devices are expensive and do not conform with the United States Golf Association ("USGA") rules of golf and the R&A rules of golf.

Golfers use a variety of methods for reading the greens. Some hold their fingers in front of their faces, some hold a golf club vertically in front of themselves (often referred to as the plumb-bob method), some use their feet to feel the different contours, and others use various combinations of the above.

Golfers often look for new methods to improve their abilities to read the greens, and in particular for methods that utilize equipment that conforms with the rules of golf (as defined by the USGA and R&A). The products and methods disclosed in herein seek to assist golfers with providing improved products and methods for their alignment by utilizing the balance point of the golf club along the shaft that will produce at least one level horizontal edge of the golf club's shaft while being balanced by hand or finger from such balance point. The level horizontal edge of the club's shaft can then be used as a reference of a true level horizontal plane of the shaft's edge, by which the player can use to better identify contour changes while reading the green, and thus knowing where to aim prior to taking their stroke.

BRIEF SUMMARY

In an exemplary embodiment, a shaft for a golf club is disclosed. The shaft includes a first end, a second end, and a demarcation that is used for balancing the golf club horizontally. The first end is adapted to attach to a club head. The second end is distal to the first end and is adapted to engage a grip. The demarcation is positioned at the balance point of the golf club between the first end and the second end such that it will produce at least one level horizontal edge of the golf club's shaft while being balanced by hand or finger from such demarcation and balance point. The demarcation can be created in many different ways and may take many different forms, of which several forms and methods of the demarcation will be outlined in embodiments discussed. The demarcation can be formed in or as part of the shaft of the golf club, or the demarcation can be a product that is attached to the shaft of the golf club at the balance point of the golf club.

DETAILED DESCRIPTION OF ILLUSTRATIVE EMBODIMENTS

Figure 1:
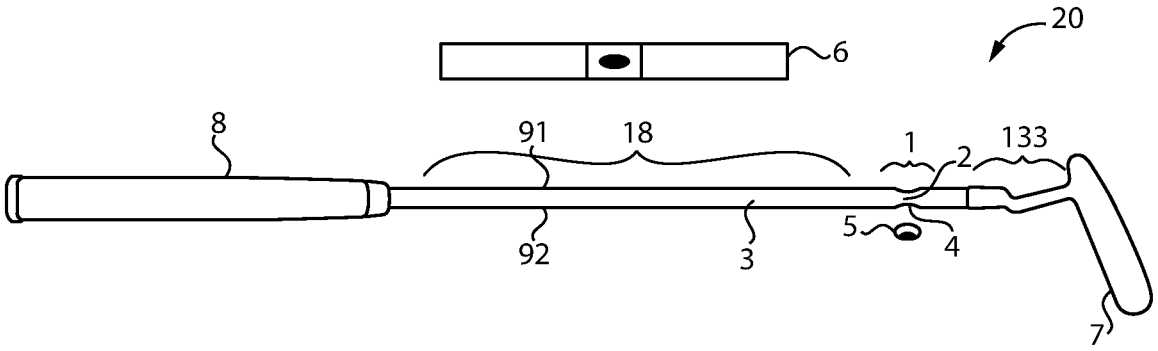
FIG. 1 is a side perspective view of an embodiment of a demarcation formed in the shaft of a golf club at the balance point of the golf club.

Although the concepts of the present disclosure are susceptible to various modifications and alternative forms, specific embodiments have been shown by way of example in the drawings and will be described herein in detail. It should be understood, however, that there is no intent to limit the concepts of the present disclosure to the particular forms disclosed, but on the contrary, the intention is to cover all modifications, equivalents, and alternatives consistent with the present disclosure and the appended claims.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. It should further be appreciated that although reference to a "preferred" component or feature may indicate the desirability of a particular component or feature with respect to an embodiment, the disclosure is not so limiting with respect to other embodiments, which may omit such a component or feature. Further, when a particular feature, structure, or characteristic is described in connection with an embodiment, it is submitted that it is within the knowledge of one skilled in the art to implement such feature, structure, or characteristic in connection with other embodiments whether or not explicitly described.

Furthermore, motion or spacing along a direction defined by one of the axes need not preclude motion or spacing along a direction defined by another of the axes. For example, elements that are described as being "laterally offset" from one another may also be offset in the longitudinal and/or transverse directions, or may be aligned in the longitudinal and/or transverse directions. The terms are therefore not to be construed as limiting the scope of the subject matter described herein to any particular arrangement unless specified to the contrary.

Additionally, it should be appreciated that items included in a list in the form of "at least one of A, B, and C" can mean (A); (B); (C); (A and B); (B and C); (A and C); or (A, B, and C). Similarly, items listed in the form of "at least one of A, B, or C" can mean (A); (B); (C); (A and B); (B and C); (A and C); or (A, B, and C). Items listed in the form of "A, B, and/or C" can also mean (A); (B); (C); (A and B); (B and C); (A and C); or (A, B, and C). Further, with respect to the claims, the use of words and phrases such as "a," "an," "at least one," and/or "at least one portion" should not be interpreted so as to be limiting to only one such element unless specifically stated to the contrary, and the use of phrases such as "at least a portion" and/or "a portion" should be interpreted as encompassing both embodiments including only a portion of such element and embodiments including the entirety of such element unless specifically stated to the contrary.

In the drawings, some structural or method features may be shown in certain specific arrangements and/or orderings. However, it should be appreciated that such specific arrangements and/or orderings may not necessarily be required. Rather, in some embodiments, such features may be arranged in a different manner and/or order than shown in the illustrative figures unless indicated to the contrary. Additionally, the inclusion of a structural or method feature in a particular figure is not meant to imply that such feature is required in all embodiments and, in some embodiments, may be omitted or may be combined with other features.

In various embodiments, the present disclosure relates to products, systems, and methods for reading putting greens on a golf course using a golf club, such as the putter, in a horizontal, balanced, position. Each golf club has a balance point that generally falls somewhere along the shaft that can be used to balance the golf club 20 horizontally in such a way that produces at least one edge of the club's shaft in a horizontal and level position when being balanced by hand/finger from such balance point. This level horizontal shaft edge can then be used as a frame of reference by the golfer to assist with visualizing contour changes of the putting green while reading the greens. The exact location of the balance point of the entire golf club is many times the same as or very close to the center of gravity of the golf club, but given the wide variation of golf club components, shapes and component weightings, the term balance point is more appropriate and is based on the relative weights and positions of the various components of the golf club, such as the shaft, club head, grip, etc.

Once known and marked on the shaft, the balance point can be used to balance the golf club 20 horizontally to produce at least one edge of the shaft of the balanced golf club that will be horizontal and level, and thus can be used as a frame of reference by which a player can compare the topography of the green to identify changes in the contour of the green, and thus where to aim prior to taking their stroke. A demarcation used for balancing is formed into or attached onto the shaft at or adjacent to the balance point of the golf club. The demarcation may then be used by the golfer to position a hand/finger, and the like, thereunder to horizontally balance the golf club from such balance point and demarcation in such a way to produce at least one horizontal and level edge of the shaft of the golf club. As disclosed in greater detail below, in various embodiments, the types of the demarcation can include one or more of a notch, a groove, an indentation, a taper, a curve, a bend, an insert, an adhesive strip, a change in texture, a change in color, a change in material, a sleeve, a pair of clamshells, an aesthetic feature (e.g., a logo or paint), and the like to physically demark the balance point of the golf club from other portions of the golf club's shaft.

As noted above and described in further detail below, the demarcation may be placed at or adjacent the balance point of the golf club. In certain forms, the demarcation may be provided at the balance point. In certain embodiments, the demarcation may be provided adjacent the balance point. For example, a demarcation that is adjacent the balance point may be within one inch of the balance point, within a half inch of the balance point, or within a quarter inch of the balance point. A demarcation at the balance point may indicate to a user that the user is intended to place a hand or finger at the demarcation in order to balance the golf club. A demarcation adjacent the balance point may indicate to the user that the user is intended to place a hand or finger to one side of the demarcation in order to balance the golf club. For example, a demarcation according to certain embodiments may be provided as one or more projections. A projection at the balance point may be utilized as a fulcrum for balancing of the club, whereas a projection adjacent the balance point may provide lateral support for the user's finger while balancing the club.

Figure 2:
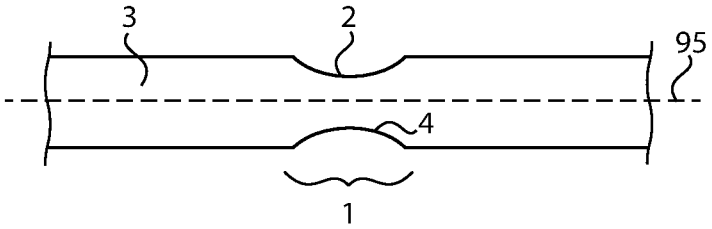
FIG. 2 is a close up perspective view of a portion of the shaft where the demarcation lies of FIG. 1.

With reference to FIGS. 1 and 2, illustrated therein is a golf club 20 including a demarcation 1 according to certain embodiments. More particularly, FIG. 1 is a side perspective view of an embodiment of a demarcation 1 of the shaft 3 as part of the golf club 20, and FIG. 2 is a plan view of a portion of the shaft 3 where the demarcation 1 lies. Also illustrated in FIG. 1 is a level 6 illustrating that when the golf club 20 is balanced at or adjacent the demarcation 1, the club 20 has at least one level, horizontal edge 91/92. The golf club 20 generally includes a shaft 3, a club head 7, and a grip 8. In the embodiment illustrated, the golf club 20 is a putter. The club head 7 is attached to a first end of the shaft 3, and the grip 8 is positioned on an opposite second or distal end of the shaft 3. Due to the weight of the club head 7, the balance point 2 of the golf club 20 is typically positioned along the shaft 3 closer to the club head 7 than to the grip 8. In the illustrated form, the club head 7 includes a neck 133 that connects to shaft 3. In such forms, the neck 133 may be considered part of club head 7.

Figure 3:
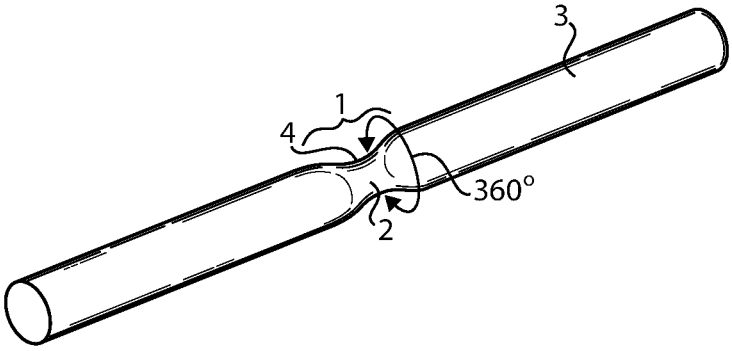
FIG. 3 is an alternate perspective view of an embodiment of the portion of the shaft of FIG. 2 showing the demarcation is 360 degrees around the shaft.
Figure 40:
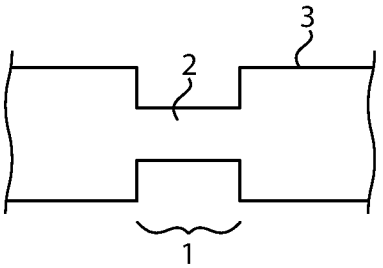
FIG. 40 is a close-up view of a portion of a shaft including a demarcation having a rectilinear cross-section.
Figure 39:
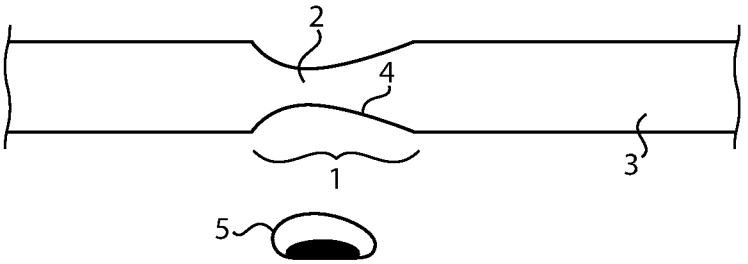
FIG. 39 is a close up perspective view of a portion of the shaft similar to FIG. 2, and illustrates that the demarcation may be asymmetrical or customized to better match any individuals hand/finger shape, if desired or needed.

The shaft 3 includes a balancing demarcation 1 that identifies and is placed at the balance point 2 of the golf club 20. The balance point 2 of the golf club 20 is one that will produce at least one level horizontal edge 91/92 of the shaft 3 while the golf club 20 is being balanced by hand/finger 5 from such balance point 2 and demarcation 1. The shaft 3 may be manufactured of metal, graphite, and the like, or other shaft materials both known and unknown. In the embodiment illustrated, the demarcation 1 is formed directly into the shaft 3 and is provided as an indentation 4 in the shaft 3. In particular, in the embodiment of FIGS. 1-3, the indentation 4 is an annular groove having an hourglass shape about a straight longitudinal axis 95 of the shaft 3. In the embodiment illustrated, the hourglass shape is a symmetrical curve. The symmetrical shape of the annular groove is adapted to have a shape similar to that of a human's finger 5, such as to match a width of the finger 5 or a height of the finger 5, which allows annular groove to rest comfortably on the finger 5. While the indentation 4 in FIGS. 1-3 is symmetrical, a human's hand/finger 5 can be both symmetrical or asymmetrical. As such, in other embodiments, the indentation 4 hourglass shape and annular groove demarcation can alternatively be formed asymmetrically, for example as shown in FIG. 39. Moreover, while certain illustrated demarcations are curvilinear in cross-section, it is also contemplated that a demarcation may be rectilinear in cross-section, for example as shown in FIG. 40. Indeed, the indentation may be provided with any geometry feasible or desirable.

Figure 36:
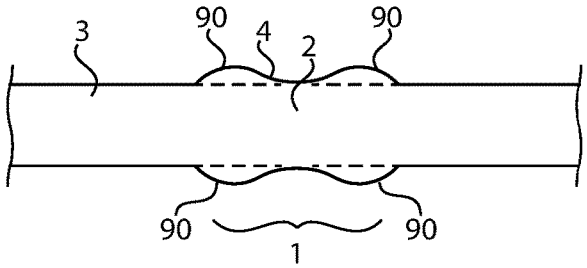
FIG. 36 is a close up perspective view of a portion of the shaft where the demarcation is formed between protrusions and lies similar as to the section of the shaft shown in FIG. 2.

The demarcation 1 being formed of an indentation 4, such as the annular groove shown in FIGS. 1 and 2, identifies the balance point 2 of the golf club 20, and assists the player with being able to more easily balance the entire club 20 by providing side support for the player's finger 5. This support can help keep the entire club 20 from teetering in a seesaw-type fashion on a player's finger 5 when being balanced horizontally and level from such demarcation 1 and balance point 2. While the embodiment shown illustrates an indentation 4 wide enough to receive a finger 5, in alternative options, the indentation 4 can be narrow or shallow, but wide enough and deep enough such that the indentation 4 is adapted to be felt by the player's finger 5. Further, in the embodiment shown, the indentation 4 is an indentation from the diameter of the shaft 3. In other embodiments, for example as shown in FIG. 36, the demarcation 1 of the shaft 3 includes protrusions 90 forming the indentation 4 therebetween, the indentation 4 being indented relative to the protrusions 90 rather than to the standard diameter of the shaft 3.

By using the demarcation 1 to identify the balance point 2 of the golf club 20 and where to position a finger 5, the player can know where to and more easily balance the golf club 20 horizontally to produce at least one level horizontal shaft edge 91/92. The horizontal and level position of at least one shaft edge 91/92 is demonstrated in FIG. 1 by the level 6 shown therein. By balancing the club as described, a player will be given at least one level straight horizontal edge along at least one of the top edge 91 (the edge along the shaft 3 opposite the finger) or the bottom edge 92 (the edge along the shaft 3 that is engaged by the finger) by which the player can use as a frame of reference of true level horizontal to better visually identify changes in contour on the golf course, and most specifically on the putting green. The level, horizontal, straight shaft edge 91/92 may assist players to better understand which direction to aim prior to addressing and taking their golf stroke.

Figure 37:
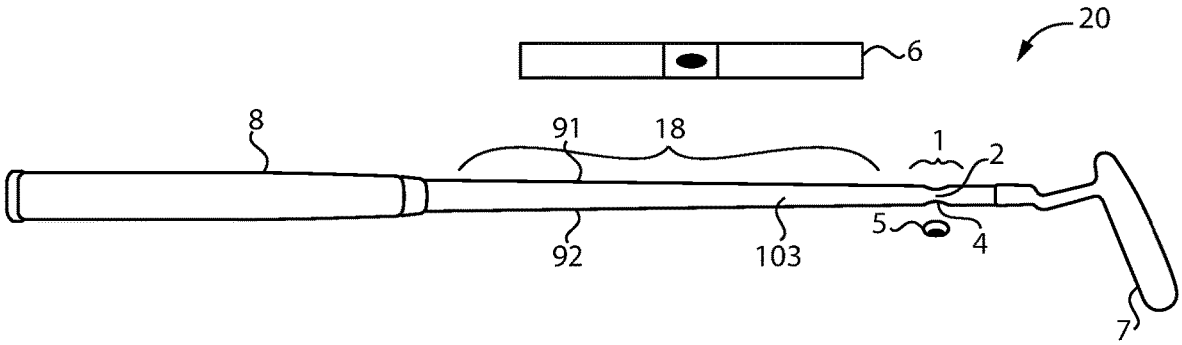
FIG. 37 is a similar side perspective view of the golf club as shown FIG. 1, but utilizing a tapered shaft in place of the parallel shaft that is shown in FIG. 1.

In an embodiment illustrated in FIGS. 1 and 2, the shaft 3, outside of the indentation 4, generally has a uniform thickness, at least along the length 18. With a shaft of uniform thickness, it is possible to have both edges 91/92 of the shaft 3 level and horizontal while the golf club 20 is being balanced as the shaft edges 91, 92 are parallel to each other, at least along the length 18. In the embodiment illustrated in FIG. 37, by contrast, the shaft 103, outside of indentation 4, generally has a tapered thickness along the length 18, and the tapered shaft 103 diameter is smaller closer to the club head and larger closer to the grip. In either option, the demarcation 1, and in particular, the middle of the symmetrical hourglass shape of the indentation 4, is positioned at or adjacent to the balance point 2 that will produce at least one level horizontal edge 91/92 of the shaft of the golf club while being balanced by hand/finger 5 from such demarcation 1 and balance point 2. As shown in FIG. 37, the edge 91 of the shaft 103 is horizontal and level and runs parallel to the level 6 shown, while the taper of the shaft 103 does not allow the opposing shaft edge 92 to be level based on the taper of the shaft 103. In FIG. 1, with a shaft that does not taper, both edges 91/92 of the shaft are parallel to the level 6 shown.

Figure 38:
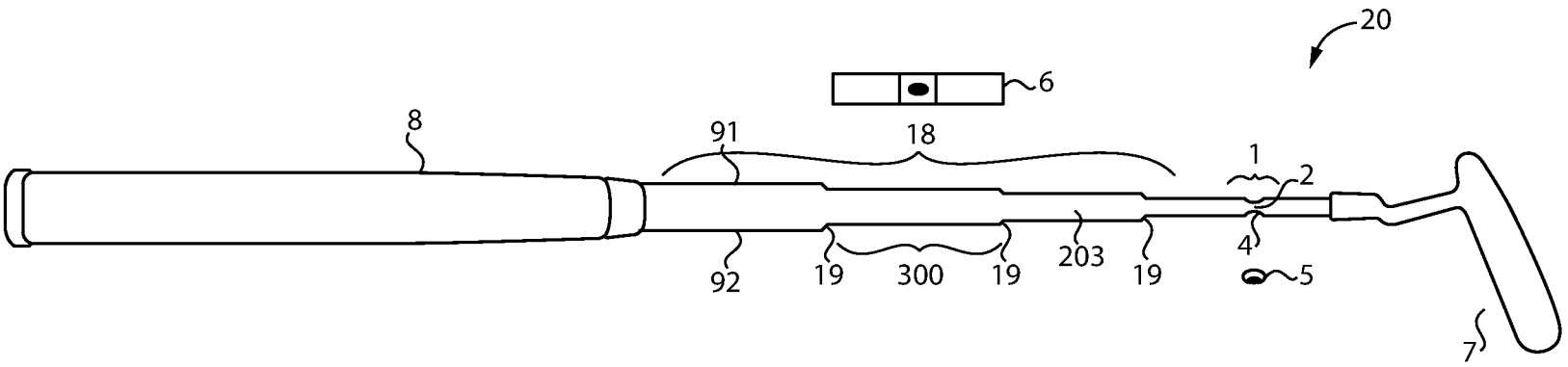
FIG. 38 is a similar side perspective view of the golf club as shown FIG. 1, but utilizing a stepped shaft in place of the parallel shaft that is shown in FIG. 1.

FIG. 38 is a perspective view a shaft 203 according to certain embodiments, which includes steps 19. Generally, the steps 19 increase in diameter from the club head 7 to the butt end of the club 20, where the grip 8 is located. Due to the stepped nature of the shaft 203, the demarcation is positioned at the balance point 2, where a desired section of shaft 203 between two different steps 19 that produces at least one level horizontal shaft edge 91/92 of the shaft 203 of the golf club 20 when balanced by hand/finger 5 from such demarcation 1 and balance point 2.

In certain embodiments, the portion of the shaft 3 that does not comprise the demarcation 1 may have a standard diameter typical to golf shafts, and the demarcation 1 may have a lesser diameter. In other embodiments, the demarcation 1 may have the standard diameter typical to golf clubs, and the shaft 3 may include regions of greater diameter on either side of the standard-diameter demarcation. For example, if the demarcation 1 is provided in the form of a recess and a particular diameter is required for rigidity of the club, the demarcation 1 may have the particular diameter, and the regions on either side of the demarcation 1 may have a greater diameter.

Figure 4:
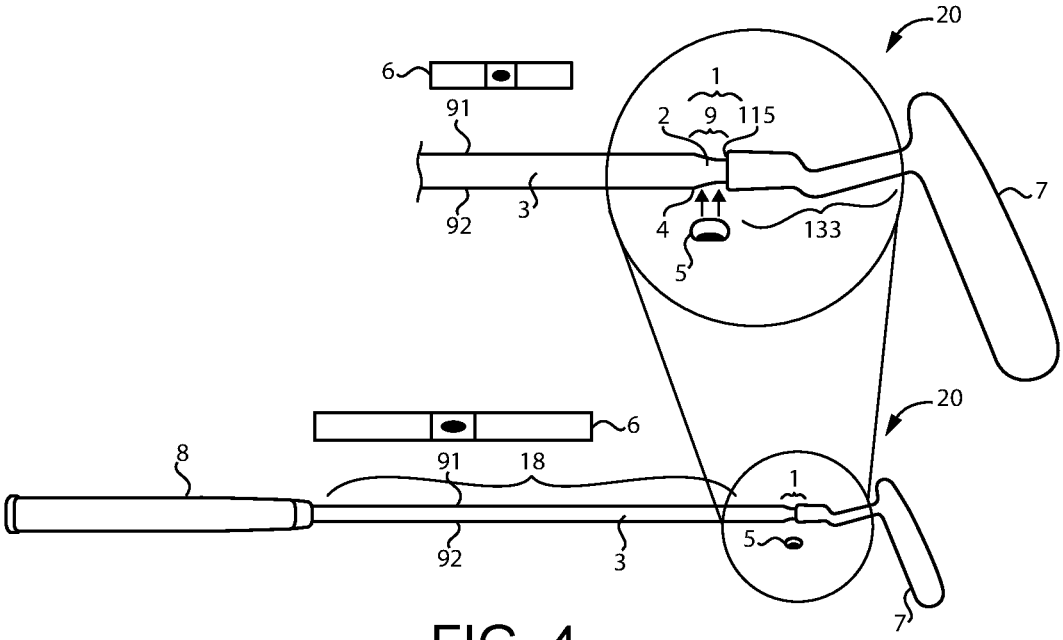
FIG. 4 is a side perspective view of another embodiment of the golf club with a golf shaft that has a demarcation formed in the shaft at the balance point of the golf club, wherein the demarcation is in the configuration of a half of an hourglass.

With additional reference to FIG. 4, illustrated therein is a side perspective view of another embodiment of a version of demarcation 1 of the shaft 3 of the golf club 20. The demarcation 1 is a transition 9 in the shaft 3 forming one half of an hourglass shape. In certain embodiments, the half-hourglass shape can be used in combination with the collar 115 of the neck 133 of the club head 7, which will essentially create the indentation 4 between the larger shaft diameter section of the shaft 3 prior to the shaft transition 9 and the collar 115 of the neck 133 of the club head 7.

This embodiment, while still providing support for a hand/finger 5 on both sides of indentation 4, has a more traditional in nature shaft design, where the diameter of the shaft becomes smaller as one progresses from grip end of the shaft 3 to the end of the shaft 3 that engages the club head 7. By having only one side of the hourglass curve in shaft 3, the shaft 3 can be considered a version of tapered.

Figure 5:
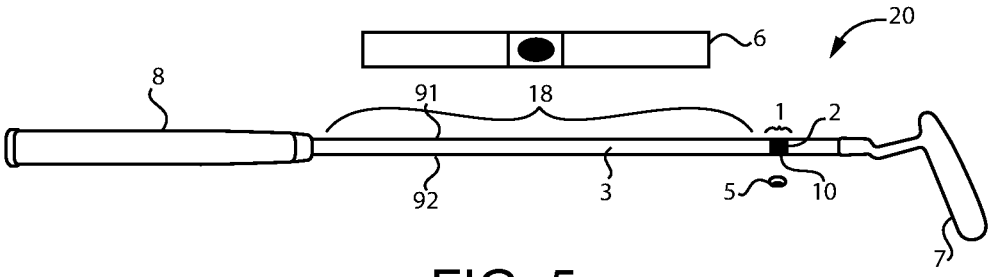
FIG. 5 is a side perspective view of a further embodiment of the golf club with a golf shaft that has a color change marking as the demarcation that is placed and marks the balance point of the golf club.

With additional reference to FIG. 5, illustrated therein is a side perspective view of another embodiment of a demarcation 1 of the shaft 3. The demarcation 1 is formed by at least one characteristic change 10, such as a textural change, a material change, and/or a color change. The characteristic change 10 can be accomplished using all current and future methods practiced including dye, ink, paint, textural spray/composite or a material substitution during the manufacturing process to form the demarcation 1 and mark the position of the balance point 2 of the golf club 20. The characteristic change 10 can be as small as a hairline size marking, or can be wider. In the embodiment shown in FIG. 5, the characteristic change 10 is approximately a width of one of a typical finger width. The demarcation 1 is positioned at the balance point 2 that will produce at least one horizontal level edge 91/92 of the shaft 3 while being balanced by hand/finger 5 from such demarcation 1 and balance point 2.

Figure 6:
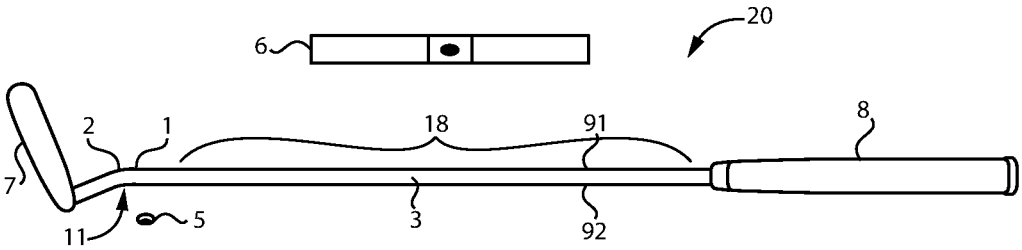
FIG. 6 is a side perspective view of yet a further embodiment of the golf club with a golf shaft that has a bend in the shaft as the demarcation of the balance point of the golf club.

With additional reference to FIG. 6, illustrated therein is a side perspective view of another embodiment of a demarcation 1 of the shaft 3 of the golf club 20. In the embodiment of FIG. 6, the demarcation 1 is formed of a bend 11 in the shaft 3. The bend 11 is formed at or adjacent to the balance point 2 that will produce at least one horizontal and level edge 91/92 of the shaft of the golf club 20 while being balanced by hand/finger 5 from such demarcation 1 and balance point 2. Again, with the demarcation 1, a level horizontal edge of the shaft 3 can be used as a reference for reading the greens.

In some unusual putter designs, the balance point 2 of the golf club can fall along the neck 133 of the golf club head 7. In these rare situations, the various forms of demarcation 1 discussed previously can be positioned in the neck 133 of the golf club head 7 as opposed to in the shaft of the golf club to produce the same level horizontal shaft result previously outlined. Any of the embodiments disclosed herein can be positioned on or formed in the neck 133 of the head so as to be positioned at the balance point 2 of the golf club 20 that falls within the neck 133 of the golf club's head 7.

Figure 7:
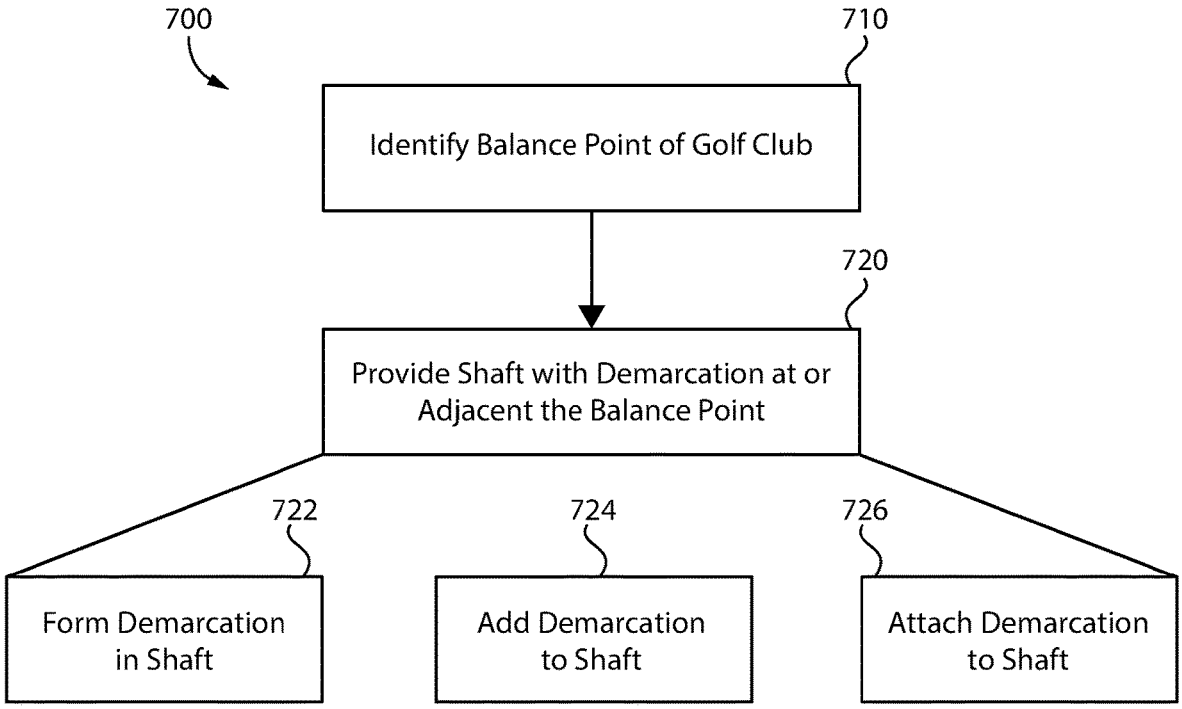
FIG. 7 is a flowchart of a method according to certain embodiments.

FIG. 7 is a flowchart of a process 700 for creating or modifying a shaft of a golf club 20 with a demarcation 1 at a balance point 2. The process 700 includes identifying the balance point 2 of the golf club 20 on the shaft 3 at block 710. More particularly, block 710 involves identifying a balance point 2 of the golf club 20 that will produce at least one level horizontal edge of the shaft 3 while the club 20 is balanced from the balance point 2. The balance point 2 may, for example, be identified by balancing the golf club 20 on a narrow item, such as a hand/finger 5, using a mechanical device to determine a more precise balance point, or using a computer model of the club 20 to determine the balance point 2 computationally.

The process 700 also includes block 720, which generally involves providing the shaft 3 with a demarcation 1 at or adjacent to the balance point 2 of the golf club 20. More particularly, block 720 involves providing the club 20 with a demarcation 1 that will produce at least one level horizontal edge of the shaft 3 when the club 20 is balanced from the balance point 2 with the aid of the demarcation 1.

Figure 35:
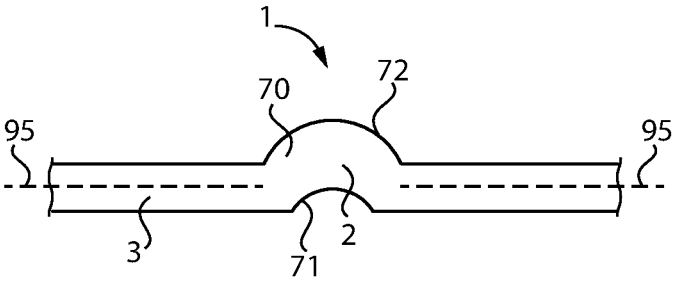
FIG. 35 is a perspective view of yet another embodiment of a version of the demarcation, which is a curve in the shaft that forms an indentation via a departure by the shaft of the central straight axis line of the shaft.

In certain embodiments, the providing of block 720 may include block 722, which generally involves forming the demarcation 1 in the shaft 3. As one example, block 722 may involve forming the demarcation 1 as an indentation in the shaft 3 at or adjacent the balance point 1, as illustrated in FIGS. 1-4 and 39. As another example, block 722 may involve forming the demarcation 1 as a bend in the shaft 3 at or adjacent the balance point, as illustrated in FIGS. 6 and 35. As a further example, block 722 may involve forming the demarcation 1 as one or more protrusions 90 at or adjacent the balance point 2, such as is illustrated in FIG. 36.

In certain embodiments, the providing of block 720 may include block 724, which generally involves adding the demarcation 1 to the shaft 3. By way of illustration, block 724 may involve providing the shaft 3 with a characteristic change 10 (e.g., one or more of a change in texture, a change in material change, and/or a change in color), for example as described with reference to FIG. 5. As another example, block 724 may involve providing the shaft 3 with an insert 13 at or adjacent the balance point 2, for example as described below with reference to FIGS. 8-11.

In certain embodiments, the providing of block 720 may include block 726, which generally involves attaching the demarcation 1 to the shaft 3. By way of illustration, block 726 may involve attaching an adhesive member to the shaft 3 at or adjacent the balance point 2, for example as described below with reference to FIGS. 12-26. As another example, block 726 may involve attaching a clamshell device to the shaft 3, for example as described below with reference to FIGS. 27-31. As a further example, block 726 may involve mounting a sleeve to the shaft, for example as described below with reference to FIGS. 32-34.

In certain embodiments, block 710 may involve determining whether the shaft 3 is uniform (e.g., as illustrated in FIG. 1), tapered (e.g., as illustrated in FIG. 37), or stepped (e.g., as illustrated in FIG. 38), and block 720 may involve providing the demarcation 1 at or adjacent to the balance point 2 based upon such determination. In such forms, block 720 may involve providing the shaft 3 with the demarcation 1 in a manner such that at least one edge 91/92 of the shaft 3 is balanced in a horizontal and level position when balanced by a hand/finger 5 from such demarcation 1 and balance point 2.

Figure 8:
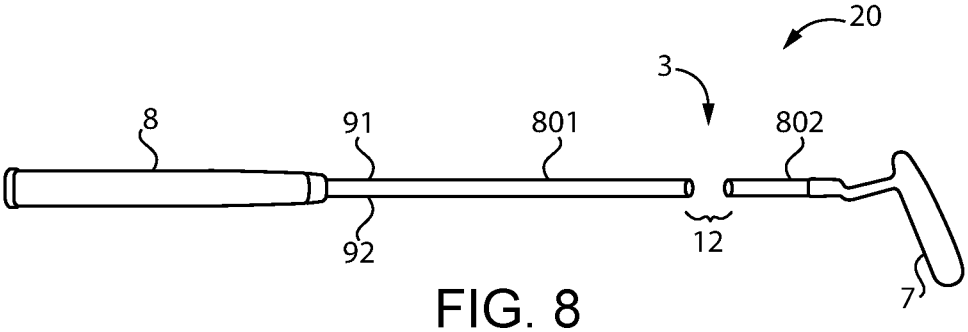
FIG. 8 is a side perspective view of a golf club with a cut shaft at or near the balance point of the golf club.
Figure 9:
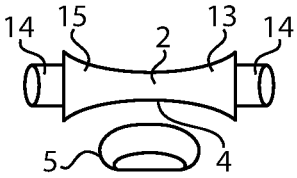
FIG. 9 is a side perspective view of a demarcation-comprising insert used to join two shaft sections.
Figure 10:
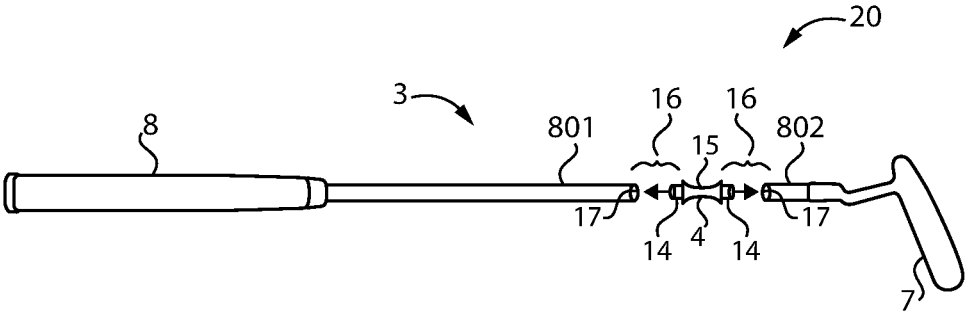
FIG. 10 is a side perspective view of the golf club with a cut shaft at the balance point of the golf club with the insert prior to assembly.
Figure 11:
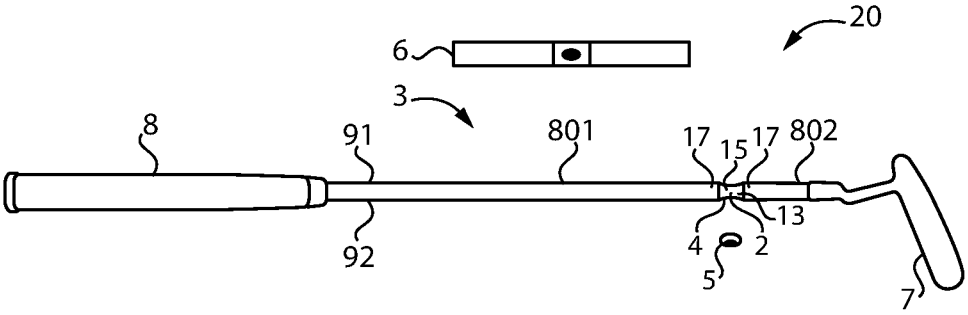
FIG. 11 is the golf club assembled with the insert connecting the cut shaft sections.

With additional reference to FIGS. 8-11, illustrated therein are various components of a golf club 20 at various stages during an embodiment of the process 700. FIG. 8 is a side perspective view of a golf club 20 with a shaft 3 having a cut 12 formed therein at the balance point 2, thereby separating the shaft 3 into a first shaft segment 801 including the grip 8 and a second shaft segment 802 including the head 7. FIG. 9 is a side perspective view of a demarcation that is provided by a golf shaft insert 13. FIG. 10 is a side perspective view of the golf club 20 with the insert 13 prior to assembly. FIG. 11 illustrates the golf club 20 assembled, with the insert 13 positioned at the balance point 2 of the golf club 20.

The illustrated insert 13 generally includes a body 15 and protrusions 14 extending from each side thereof. In the embodiment illustrated, the demarcation-comprising insert 13 includes an indentation 4, such as the indentation 4 described above with reference to FIGS. 1-4. In the embodiment illustrated, the indentation 4 includes a symmetrical, hourglass shape, and is weighted evenly such that the balance point 2 of the insert 13 is at the geometric center thereof. However, the shaft insert can be formed asymmetrically depending on the variation in the shape of a human's hand/finger 5, in which case the weight distribution of the insert 13 may be adjusted accordingly to produce the same design outcome outlined. Each protrusion 14 is sized to fit within a cavity 17 of the shaft 3. In certain embodiments, the protrusions 14 are tapered. In certain embodiments, the protrusions 14 are sized to form an interference fit with shaft 3.

In certain embodiments of the process 700, block 724 includes forming a cut 12 in the shaft 3 at the balance point 2, thereby separating the shaft 3 into a first shaft segment 801 and a second shaft segment 802. In certain embodiments, to maintain a length of the golf club 20, a length equal to that of a body 15 of the insert 13 is cut about the balance point 2 from the shaft 3. Such embodiments of the process 700 may also include positioning the insert 13 between the cut segments 801, 802 of the shaft 3 (FIG. 10), with the protrusions 14 in alignment 16 with the cavities 17 of the shaft 3. Such embodiments of the process 700 may further include inserting the protrusions 14 into respective cavities 17, such that the two segments 801, 802 of the shaft 3 are joined by the insert 13. The insert 13 may be joined to the two segments 801, 802 of the shaft 3 by an adhesive, such as glue or by current practices known for adding shaft extensions to a shaft.

As shown in FIG. 11, upon completion, the demarcation-comprising insert 13 allows the golf club 20 to be balanced by a hand/finger 5 of a player at the balance point 2 of the golf club 20 with the hand/finger 5 coming in contact with the indentation 4 of the insert 13 such that at least one edge 91/92 of the golf club's shaft 3 is level and horizontal when being balanced by hand/finger 5 from such insert 13, demarcation 1, and balance point 2. In certain embodiments, the insert 13 may be formed of the same material of the shaft 3, such as steel, graphite, and the like. In alternative embodiments, the insert 13 can be formed of a different material than that of the shaft 3.

Figure 12:
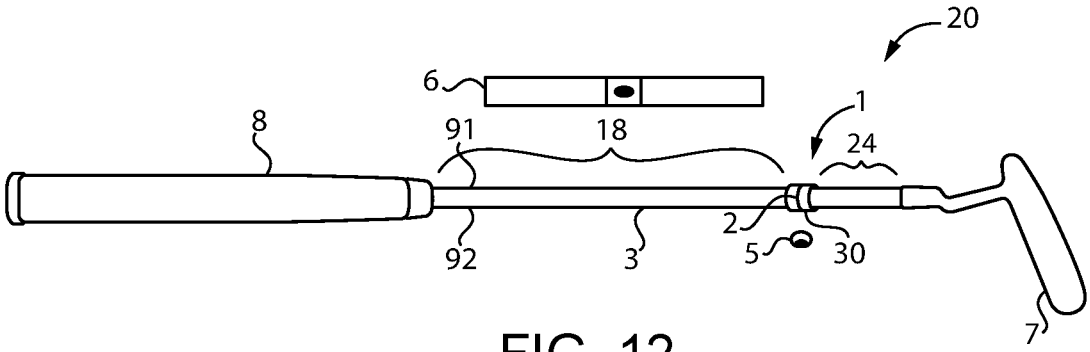
FIG. 12 is a side perspective view of still a further embodiment of a golf shaft and golf club with the demarcation being an adhesive strip applied to the shaft of the golf club at the balance point of the golf club.
Figure 13:
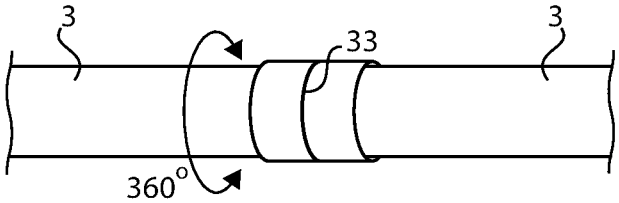
FIG. 13 is a close up perspective view of a portion of the golf shaft of the golf club of FIG. 12, wherein the adhesive strip has been applied to the shaft at the balance point of the golf club.
Figure 14:
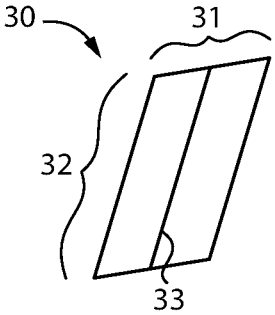
FIG. 14 is a top perspective view of the adhesive strip illustrated in FIGS. 12 and 13.
Figure 15:
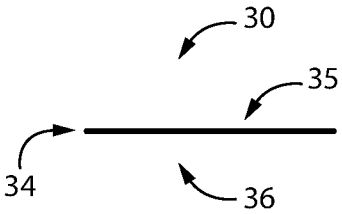
FIG. 15 is a side perspective view of the adhesive strip illustrated in FIG. 14.

With additional reference to FIGS. 12-15, illustrated therein is an embodiment of a demarcation that is formed by an adhesive strip 30. FIG. 12 illustrates the golf club 20 with the adhesive strip 30 applied at or adjacent the balance point 2. FIG. 13 is a close up perspective view of the portion of the shaft 3 of FIG. 12, where the demarcation 1 is added to the shaft 3 of golf club 20. FIG. 14 is a top perspective view of the adhesive strip 30 of FIGS. 12 and 13. FIG. 15 is a side perspective view of the adhesive strip 30 of FIG. 14. The demarcation 1 in the illustrated embodiment is an adhesive strip 30 positioned on the shaft at or adjacent to the balance point 2 of the golf club 20. The adhesive strip 30 is comprised of a material similar to that of tape or stickers, with an adhesive underside 36 that is adapted to stick and adhere to the shaft 3. The adhesive strip also includes a non-adhesive top side 35 which can have various markings 33, such as a solid line running down a middle thereof. The markings 33 can vary, such as including logos and geometric shapes that identify the balance point 2. The adhesive strip 30 is attached to the shaft 3 of the golf club 20 at the balance point 2 that will produce at least one horizontal level edge 91/92 of the shaft 3 of the golf club 20 while being balanced by hand/finger 5 from such demarcation 1 and balance point 2.

In the illustrated form, the adhesive strip 30 extends 360° around the shaft 3. As discussed above, by marking the balance point 2, a player can balance the golf club 20 by hand/finger 5 to produce at least one level horizontal edge 91/92 of the shaft 3 to better assist with visualizing and recognizing contour changes on the course, and in particular on the putting green. In particular, the edge of the upper portion 18 of the shaft 3 can be used as a reference while analyzing the contours of the green, where the lower portion 24 of the shaft that is closest to the club head 7 often includes offset curves or other bends that make the section less desirable or more difficult to use, but can be used in some circumstances. The level 6 illustrates the horizontal and level positioning of at least one edge 91/92 of shaft 3, and in particular of the upper portion 18, when the golf club 20 is balanced on the player's finger 5 from the adhesive strip demarcation 1 and balance point 2. The length 32 of the adhesive strip 30 may be adapted to be the length of the circumference around the shaft 3 at the balance point 2.

Figure 16:
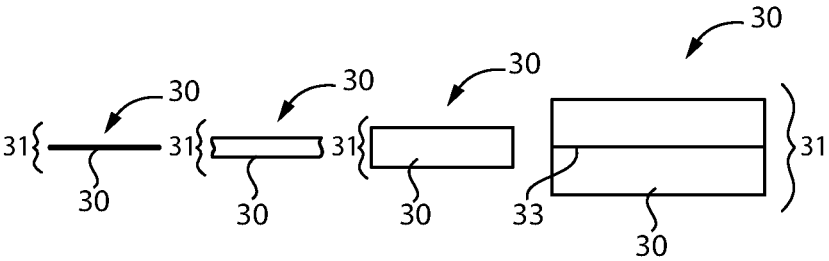
FIG. 16 is a top perspective view of varying sizes of the adhesive strips.

With additional reference to FIG. 16, illustrated therein is a top perspective view of various adhesive strip demarcations. The width 31 of the adhesive strip 30 can vary depending on desired aesthetic looks for the adhesive strip 30 and the overall golf club 20. As shown in FIG. 16, the widths 31 can be a single thin line to only demark the balance point, or may be significantly wider. In some embodiments, such as the embodiment illustrated in FIG. 13, the adhesive strip 30 includes a width 31 that is approximately the width of a finger 5.

In the embodiment illustrated in FIG. 15, the thickness 34 of the adhesive strip in the embodiment shown is that similar to tape or stickers. However, in certain embodiments, such as those illustrated in FIGS. 17-26, the alignment strip 30 includes alternative shapes that help a player better reduce any seesawing movement of the golf club 20 when balancing the golf club 20 at the balance point 2 on a hand/finger 5.

Figure 17:
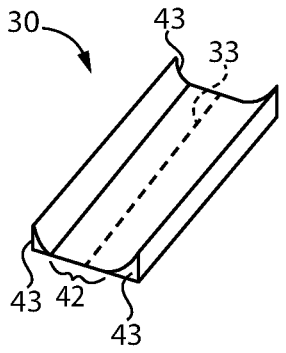
FIG. 17 is a perspective view of a top of an embodiment of an adhesive strip having shoulders on two sides of the strip.
Figure 18:
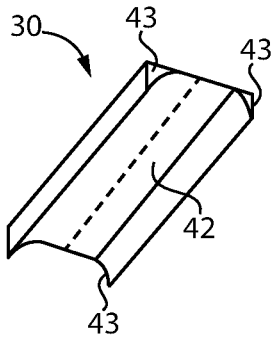
FIG. 18 is an alternate perspective view of the adhesive strip of FIG. 17.
Figure 19:
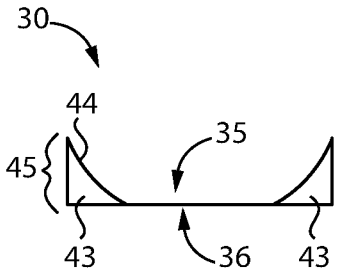
FIG. 19 is a perspective view of a side of the adhesive strip of FIG. 17.
Figure 20:
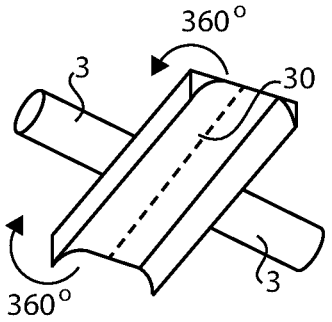
FIG. 20 is a perspective view of the adhesive strip illustrated in FIG. 17 being applied to a shaft.
Figure 21:
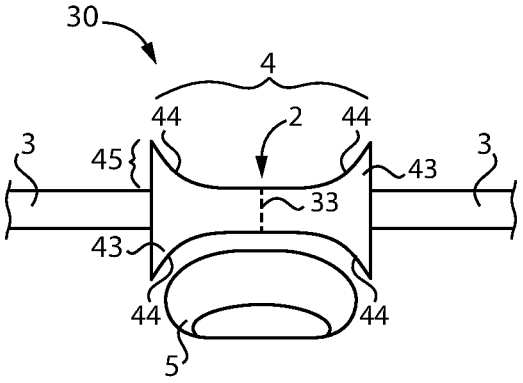
FIG. 21 is a perspective view of the adhesive strip illustrated in FIG. 17 on the shaft at the balance point.

With additional reference to FIGS. 17-21, illustrated therein are adhesive strips according to certain embodiments. FIG. 17 is a perspective view of a top of an embodiment of a demarcation 1 defined by an adhesive strip 30. FIG. 18 is an alternate perspective view of the adhesive strip 30 of FIG. 17. FIG. 19 is a perspective view of a side of the adhesive strip 30 of FIG. 17. FIG. 20 is a perspective view of the adhesive strip 30 of FIG. 17 being applied to a shaft 3. FIG. 21 is a perspective view of the adhesive strip 30 of FIG. 17 on the shaft 3.

The adhesive strip 30 includes a central portion 42 and shoulders 43 on opposite sides of the central portion 42. In the embodiment illustrated, the central portion 42 is flat. In other embodiments, the central portion 42 may be rounded, tapered, form an hourglass shape, or can be a simple inflection point joining the two shoulders 43 of the strip together, and the like. The shoulders 43 are positioned at each side of the central portion 42 and protrude radially outward from the shaft 3 at an outer top face of the adhesive strip 30 along a length of the sides thereof.

The illustrated shoulders 43 include curved surfaces 44 such that the outer surface of the adhesive strip 30 forms an indentation between the shoulders 43, such as the hourglass shape described above. The shoulders 43 can be formed of thickened tape, foam, and the like, that has sufficient rigidity to support contact with the players finger 5 and to reduce or limit any rocking of the golf club 20 during balancing of the golf club 20 by hand/finger 5 from such balance point 2 and demarcation 1.

The marking 33 of the embodiment illustrated in FIGS. 17-21 is the same or similar to the markings 33 described above with reference to FIGS. 12-16, and can be positioned in the middle of the adhesive strip 30, or can be multiple markings equidistant from the middle, and the like, such that the balance point 2 is identifiable therefrom. As can be seen in FIGS. 20 and 21, the adhesive strip 30 is adapted to be placed 360° about the shaft 3 at the balance point 2 of golf club 20 that will produce at least one horizontal level edge 91/92 of the shaft 3 of the golf club 20 while being balanced by hand/finger 5 from such demarcation 1, adhesive strip 30, and balance point 2.

In the embodiment illustrated in FIG. 21, an indentation 4 formed by the shoulders 43 of the adhesive strip has a general shape of a finger 5, and is adapted to receive a width or height of a person's hand/finger 5. Again, the shoulders 43 are configured to assist a player in better balancing the golf club 20 by discouraging a seesawing action of the golf club 20 when being balanced on the person's finger 5. A height 45 of the shoulders 43 can vary, and may be as small a raised surface to provide the slightest of support for a person's hand/finger 5.

Referring to FIGS. 20 and 21, in certain embodiments, block 720 of the above-described process 700 includes wrapping the adhesive strip 30 around the shaft 3 such that the adhesive strip 30 overlaps with the balance point 2 of the golf club 20. This may include aligning one or more of the markings 33 with a selected balance point 2, or aligning more than one of the markings in equal relation from balance point 2 if there are multiple markings on the adhesive strip 30.

Figure 22:
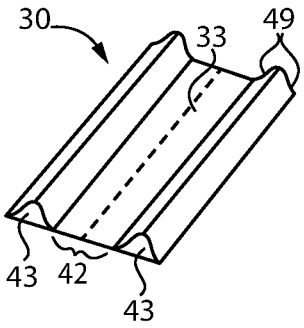
FIG. 22 is a perspective view of a top of another embodiment of the adhesive strip that has shoulders that curve on both sides of the shoulders.
Figure 23:
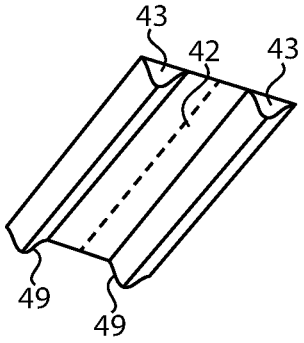
FIG. 23 is an alternate perspective view of the adhesive strip illustrated in FIG. 22.
Figure 24:
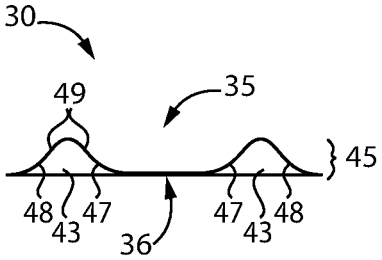
FIG. 24 is a perspective view of a side of the adhesive strip illustrated in FIG. 22.
Figure 25:
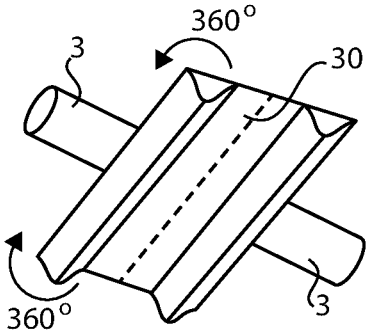
FIG. 25 is a perspective view of the adhesive strip illustrated in FIG. 22 being applied to a shaft.
Figure 26:
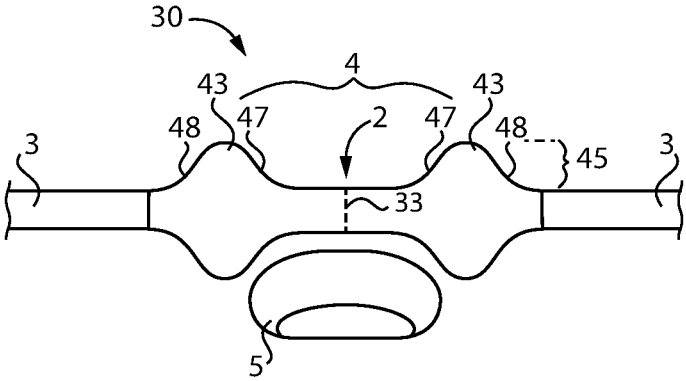
FIG. 26 is a perspective view of the adhesive strip illustrated in FIG. 22 on the shaft at the balance point.

With additional reference to FIGS. 22-26, illustrated therein is an adhesive strip 30 according to certain embodiments. FIG. 22 is a perspective view of a top of an embodiment of an adhesive strip 30 comprising or defining a demarcation 1. FIG. 23 is an alternate perspective view of the adhesive strip 30 of FIG. 22. FIG. 24 is a side view of a side of the adhesive strip 30 of FIG. 22. FIG. 25 is a perspective view of the adhesive strip 30 of FIG. 22 being applied to a shaft 3. FIG. 26 is a perspective view of the adhesive strip 30 of FIG. 22 on the shaft 3 at the balance point 2. In the embodiment illustrated in FIGS. 22-26, the shoulders 43 each include double sided walls 49 including an inner curve 47 and an outer curve 48. In certain embodiments, the inner curve 47 and the outer curve 48 of each shoulder 43 are symmetrical, but can be asymmetrical based on personal preference.

Like the curved surfaces 44 illustrated in FIG. 21, the inner curves 47 of the embodiment illustrated in FIG. 26 provide support for a person's finger 5, while the outer curves 48 provide a smoother surface at the sides of the adhesive strip 30, which acts to limit the edges from being more likely to snag on things, such as a golf bag and the like. In particular, the outer curves 48 can discourage the adhesive strip 30 from snagging on the golf bag while the golf club 20 is being taken out or put back into the golf bag. Reducing such contact at the sides of the adhesive strip 30 can improve the longevity of the adhesive strip 30 and help prevent dislocation of the adhesive bond between the adhesive strip 30 and the shaft 3.

Figure 27:
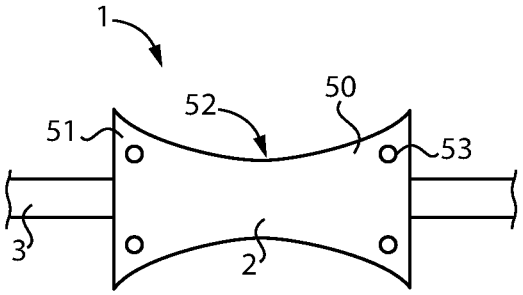
FIG. 27 is a perspective view of a top of a further embodiment of the demarcation that includes two clamshells applied to the golf shaft at the balance point of the golf club.
Figure 28:
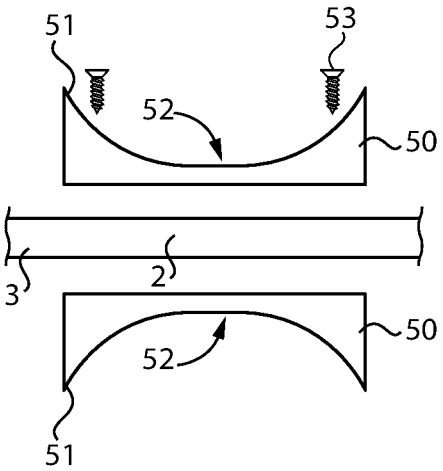
FIG. 28 is an exploded side perspective view of the demarcation illustrated in FIG. 27.
Figure 30:
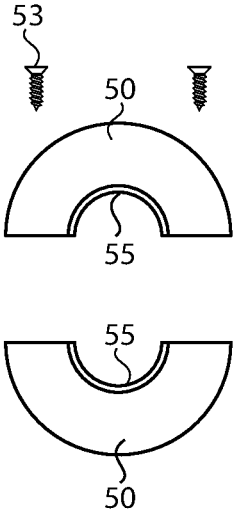
FIG. 30 is an exploded front perspective view of the demarcation illustrated in FIGS. 27-29.
Figure 29:
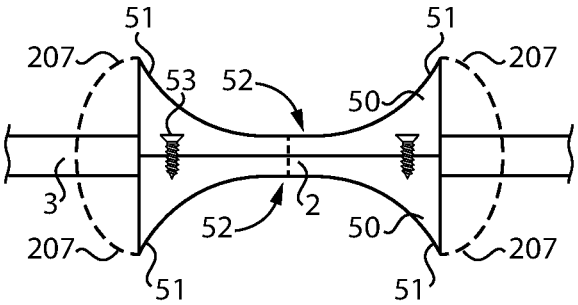
FIG. 29 is an assembled side perspective view of the demarcation illustrated in FIGS. 27-28 on the shaft at the balance point.
Figure 31:
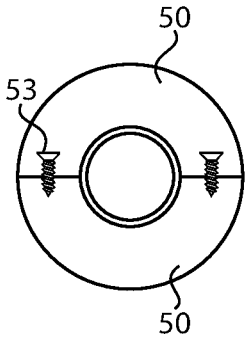
FIG. 31 is an assembled front perspective view of the demarcation illustrated in FIGS. 27-30.

With additional reference to FIG. 27-31, illustrated therein is a demarcation 1 according to certain embodiments. FIG. 27 illustrates a pair of clamshells that are shown attached around shaft 3 to define a demarcation 1 at the balance point 2. FIG. 28 is an exploded side perspective view of the demarcation 1 at the balance point 2. FIG. 29 is an assembled side perspective view of the demarcation-comprising clamshell on the shaft 3. FIG. 30 is an exploded front perspective view of the demarcation 1. FIG. 31 is an assembled front perspective view of the demarcation 1.

In the embodiments illustrated in FIGS. 27-31, the demarcation includes clamshells 50 joined together, such as by fasteners 53 around the shaft 3 at the balance point 2 of the golf club. In the illustrated embodiment, the demarcation 1 includes two symmetrical clamshells 50, the clamshells 50 including an outer surface 52 forming an hourglass shape, with shoulders 51 at each end. The shoulders 51 and the outer surface 52 define an indentation therebetween, which is defined by the hourglass shape. The body of the clamshells 50 may be made of a hard plastic or the like that provides durability and rigidity to support fasteners that connect the clamshells 50 together. In certain embodiments, an interior surface 55 of each of the clamshells 50 includes at least one of rubber, adhesive tape, or the like. In certain embodiments, the interior surface 55 includes a separate liner joined to a body of the clamshells 50. The interior surface 55 including at least one of rubber, adhesive tape, or adhesive may serve to aid the clamshell in maintaining its position on the golf shaft 3 at the balance point 2. In certain embodiments, the shoulders 51 of the clamshells can be double-curved similar to the adhesive strip in FIG. 26, and the dashed line 207 in FIG. 29 of the clamshells shows how the shoulders 51 of the clamshells could be modified to assist with reducing the likelihood the top of the clamshell shoulders 51 will snag on anything such as a golf bag while the golf club is being taken out of or put into the golf bag.

In the embodiment illustrated in FIGS. 27-31, the demarcation 1 is formed by a pair of semi-circular clamshells 50 that are in engagement with one another. In other embodiments, a clamshell-type demarcation may be formed in another manner. As one example, a clamshell may be provided with a generally C-shaped cross-section such that the single clamshell is operable to snap tightly and securely onto the shaft 3 itself without the need for engagement with a second clamshell. In such forms, the interior surface may include rubber, adhesive tape, or the like in order to discourage shifting of the clamshell once installed.

Figure 32:
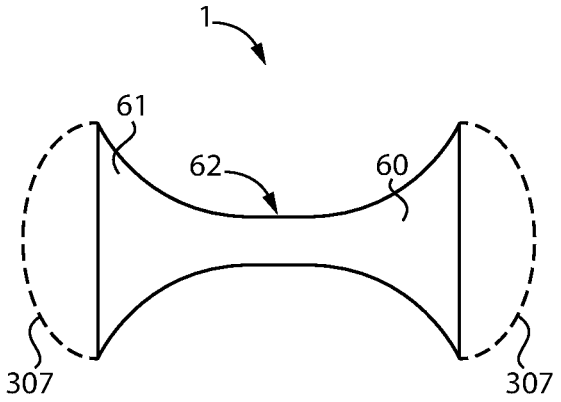
FIG. 32 is a perspective view of a further embodiment of the demarcation, which includes a sleeve to be slid onto the shaft of the golf club and positioned at the balance point along the shaft of the golf club.
Figure 33:
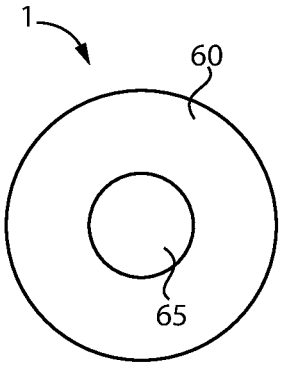
FIG. 33 is a front perspective view of the demarcation illustrated in FIG. 32.
Figure 34:
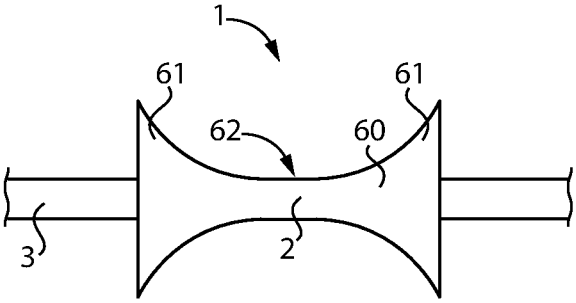
FIG. 34 is a perspective view of the demarcation illustrated in FIGS. 32 and 33 installed on a shaft at a balance point.

With additional reference to FIGS. 32-34, illustrated therein is a demarcation 1 according to certain embodiments. FIG. 32 is a side view of an embodiment of the demarcation 1 provided in the form of a sleeve. FIG. 33 is a front view of the demarcation 1 of FIG. 32. FIG. 34 is a side view of the demarcation 1 of FIGS. 32 and 33 installed on a shaft 3. In the embodiment illustrated in FIGS. 32-34, the demarcation 1 is provided as a sleeve 60 adapted to slide onto the shaft 3 and to align with the balance point 2 of the golf club 20. In certain embodiments, the sleeve 60 is secured to the shaft 3 by sliding the shaft 3 into a bore 65 of the sleeve 50 and using an adhesive, such as a double-sided adhesive strip, similar to the manner in which a grip is secured to an end of the shaft 3. In certain embodiments, the bore 65 has a diameter smaller than that of the shaft 3, resulting in an interference fit between the sleeve 60 and the shaft 3.

In the embodiment illustrated, the sleeve 60 includes an outer surface 62 forming an hourglass shape, with shoulders 61 at each end. The shoulders 61 and the outer surface 62 define an indentation therebetween, which is defined by the hourglass shape. The sleeve 60 may, for example, be made of rubber, silicon, or other materials that are currently used for golf grips. In other embodiments, other types of identifying features for identifying the balance point 2 are used, including those disclosed above, such as logos, lines, grooves, notches, and the like. These identifying features can be used in conjunction with the hourglass shape or in place of the hourglass shape. Again, as shown with the clamshells previously, the shoulders of the sleeve 60 can be double curved as shown in the dashed line 307 in FIG. 32 to reduce snagging while being placed into or taken out of a golf bag.

FIG. 35 is a perspective view of yet another embodiment of the demarcation 1. In the embodiment illustrated in FIG. 35, the demarcation 1 is a curve 70 formed into the shaft 3 that forms an indentation 71. The demarcation 1 includes a curve 70 in the shaft 3, where the curve is placed at the balance point 2. In the embodiment illustrated, the curve 70 is a short deviation from the central straight shaft axis 95 of shaft 3. This differs from certain previously-described embodiments, in which the central axis of the shaft 3 remains straight. In the embodiment illustrated, the resulting curve 70 defines an indentation 71 on one side of the shaft 3 and a protrusion 72 on an opposing side of the shaft 3. In other embodiments, the indentation 71 may be provided without a corresponding protrusion 72 on the opposite side of the shaft 3.

In some embodiments, combinations of the demarcations 1 are used together, and indeed, any combination of the demarcations disclosed herein can be used together.

Although the present disclosure has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present disclosure, are contemplated thereby, and are intended to be covered by the following claims.

What is claimed is:

1. A shaft for a golf club, comprising:
a first end adapted to attach to a club head;
a second end distal to the first end and adapted to receive a grip; and
a demarcation positioned on or formed in the shaft, wherein the demarcation is located at or adjacent to a balance point of the golf club between the first end and the second end.

2. The shaft of claim 1, wherein the demarcation comprises an indentation formed in the shaft between at least two points along the shaft with larger diameters.

3. The shaft of claim 2, wherein the indentation comprises an annular groove.

4. The shaft of claim 3, wherein the annular groove comprises an hourglass shape.

5. The shaft of claim 1, wherein the demarcation forms a taper between adjoining portions of the shaft with different diameters.

6. The shaft of claim 1, wherein the demarcation comprises a bend or curve in the shaft.

7. The shaft of claim 1, further comprising an adhesive strip, the adhesive strip comprising the demarcation.

8. The shaft of claim 7, wherein the adhesive strip includes a central portion and shoulders positioned at opposite sides of the central portion; and
wherein the shoulders project radially outward from the shaft such that an indentation is defined between the shoulders.

9. The shaft of claim 1, further comprising at least one clamshell attached to the shaft, wherein the at least one clamshell comprises the demarcation.

10. The shaft of claim 9, wherein the at least one clamshell comprises a pair of clamshells coupled about the shaft.

11. The shaft of claim 1, further comprising a sleeve slid onto the shaft, wherein the sleeve comprises the demarcation.

12. The shaft of claim 1, wherein the shaft comprises:
a first shaft segment comprising the first end;
a second shaft segment comprising the second end; and
an insert coupling the first shaft segment and the second shaft segment, wherein the insert comprises the demarcation.

13. The shaft of claim 12, wherein one of the first shaft segment or the second shaft segment comprises a cavity; and
wherein the insert comprises a protrusion received in the cavity.

14. The shaft of claim 1, wherein the shaft comprises a shaft segment comprising the second end, and an insert coupled to the shaft segment, the insert comprising the demarcation.

15. The shaft of claim 14, wherein the shaft segment comprises a cavity; and wherein the insert comprises a protrusion received in the cavity.

16. A golf club, comprising:

the shaft of claim 1;

a club head connected to the first end of the shaft; and a grip engaged with the second end of the shaft;

wherein the balance point is located between the club head and the grip.

17. The golf club of claim 16, wherein the demarcation comprises an indentation formed in the shaft between at least two points along the shaft with larger diameters.

18. The golf club of claim 17, wherein the indentation comprises an annular groove.

19. The golf club of claim 18, wherein the annular groove comprises an hourglass shape.

20. The golf club of claim 16, wherein the demarcation forms a taper between adjoining portions of the shaft with different diameters.

21. The golf club of claim 16, wherein the demarcation comprises a bend or curve in the shaft.

22. The golf club of claim 16, further comprising an adhesive strip, wherein adhesive strip comprises the demarcation and is wrapped around a portion of the shaft.

23. The golf club of claim 22, wherein the adhesive strip includes a central portion and shoulders positioned on opposite sides of the central portion that project radially outward from the shaft such that an indentation is formed between the shoulders.

24. The golf club of claim 16, further comprising a first clamshell attached to the shaft, wherein the first clamshell comprises at least a portion of the demarcation.

25. The golf club of claim 24, further comprising a second clamshell coupled with the first clamshell such that the shaft is captured between the first clamshell and the second clamshell.

26. The golf club of claim 16, further comprising a sleeve slid onto the shaft, wherein the sleeve comprises the demarcation.

27. The golf club of claim 16, wherein the shaft has at least one horizontal and level edge when balanced at the balance point.

28. The golf club of claim 16, wherein the shaft comprises:

a first shaft segment comprising the first end;

a second shaft segment comprising the second end; and an insert coupling the first shaft segment and the second shaft segment, wherein the insert comprises the demarcation.

29. The golf club of claim 28, wherein one of the first shaft segment or the second shaft segment comprises a cavity; and wherein the insert comprises a protrusion received in the cavity.

30. The golf club of claim 16, further comprising an insert coupled with the shaft, the insert comprising the demarcation.

31. The golf club of claim 30, wherein the shaft comprises a cavity; and wherein the insert comprises a protrusion received in the cavity.

32. A method of creating or modifying the golf club of claim 16, the method comprising:

identifying the balance point of the golf club, wherein the balance point is located on the shaft; and providing the shaft with the demarcation at or adjacent to the balance point of the golf club.

33. The method of claim 32, further comprising determining whether the shaft has a uniform configuration, a tapered configuration, or a stepped configuration;

wherein the demarcation is provided to the shaft at or adjacent to the balance point of the golf club based on the determining.

34. The method of claim 32, wherein providing the shaft with the demarcation comprises:

cutting the shaft into a first shaft segment and a second shaft segment;

positioning an insert between the first shaft segment and the second shaft segment, wherein the insert comprises the demarcation; and joining the first shaft segment and the second shaft segment to opposite ends of the insert.

35. The method of claim 34, wherein one of the first shaft segment or the second shaft segment comprises a cavity;

wherein the insert comprises a protrusion; and wherein joining the first shaft segment and the second shaft segment to opposite ends of the insert comprises inserting the protrusion into the cavity.

36. The method of claim 32, wherein providing the shaft with the demarcation comprises applying an adhesive strip to the shaft at or adjacent to the balance point of the golf club; and wherein the adhesive strip comprises the demarcation.

37. The method of claim 36, wherein the adhesive strip comprises a pair of shoulders having an indentation defined therebetween.

38. The method of claim 32, wherein providing the shaft with the demarcation comprises positioning at least one clamshell on the shaft at or adjacent to the balance point of the golf club; and wherein at least one clamshell comprises the demarcation.

39. The method of claim 38, wherein the at least one clamshell comprises a pair of clamshells.

40. The method of claim 32, wherein providing the shaft with the demarcation comprises positioning a sleeve at or adjacent to the balance point of the golf club; and wherein the sleeve comprises the demarcation.

41. The method of claim 32, wherein providing the shaft with the demarcation comprises:

cutting the club into a first club segment and a second club segment;

positioning an insert between the first club segment and the second club segment, wherein the insert comprises the demarcation; and joining the first club segment and the second club segment to opposite ends of the insert.

* * * * *